US010428671B2

(12) United States Patent
Jones

(10) Patent No.: US 10,428,671 B2
(45) Date of Patent: Oct. 1, 2019

(54) SEALING ATTACHMENT FOR A GAS TURBINE ENGINE

(71) Applicant: ROLLS-ROYCE plc, London (GB)

(72) Inventor: Simon L Jones, Bristol (GB)

( * ) Notice: Subject to any disclaimer, the term of this patent is extended or adjusted under 35 U.S.C. 154(b) by 507 days.

(21) Appl. No.: 15/222,025

(22) Filed: Jul. 28, 2016

(65) Prior Publication Data

US 2017/0044917 A1 Feb. 16, 2017

(30) Foreign Application Priority Data

Aug. 10, 2015 (GB) ..... 1514093.2

(51) Int. Cl.
*F01D 25/24* (2006.01)
*F01D 11/00* (2006.01)

(52) U.S. Cl.
CPC ..... *F01D 11/005* (2013.01); *F01D 25/246* (2013.01); *F05D 2250/711* (2013.01); *F05D 2250/75* (2013.01); *F05D 2260/37* (2013.01); *F05D 2260/38* (2013.01)

(58) Field of Classification Search
None
See application file for complete search history.

(56) References Cited

U.S. PATENT DOCUMENTS 3,965,066 A 6/1976 Sterman et al.
4,537,024 A * 8/1985 Grosjean ..... F01D 11/005 415/139
4,781,388 A * 11/1988 Wohrl ..... F01D 11/005 165/159
5,988,975 A 11/1999 Pizzi
6,431,825 B1 8/2002 McLean
(Continued)

FOREIGN PATENT DOCUMENTS

GB 2396193 A 6/2004
JP 2003-286808 A 10/2003
(Continued)

OTHER PUBLICATIONS

Jan. 13, 2016 Search Report issued in British Patent Application No. 1514093.2.
(Continued)

*Primary Examiner* — Carlos A Rivera
*Assistant Examiner* — Theodore C Ribadeneyra
(74) *Attorney, Agent, or Firm* — Oliff PLC

(57) ABSTRACT

A gas turbine including: a wall component having a gas-facing surface bounding the main gas path; a male-female sealing attachment having a male or female part in which: the male-part includes a component having a main-body, which has first and second arms extending in a common direction and either side of a mid-line plane, wherein the arms are convexly curved in relation to the mid-line plane so as to provide a contact-portion along the length of the arm, the contact-portion being furthest from the mid-line plane; and, the female-part includes a component having a main-body, which includes first and second arms extending therefrom in a common direction and either side of a mid-line plane, wherein the first and second arms are concavely curved in relation to the mid-line plane so as to provide a contact-portion along the length of the arm, the contact portion being closest to the mid-line plane.

15 Claims, 3 Drawing Sheets

(56) References Cited

U.S. PATENT DOCUMENTS

| | | | | |
|---|---|---|---|---|
| 7,316,402 | B2 * | 1/2008 | Paauwe | F01D 11/005 277/641 |
| 7,360,769 | B2 * | 4/2008 | Bennett | F01D 11/005 277/641 |
| 7,832,734 | B2 * | 11/2010 | Beichl | F01D 11/001 277/355 |
| 7,901,186 | B2 * | 3/2011 | Cornett | F01D 11/005 277/643 |
| 8,714,565 | B1 * | 5/2014 | Cornett | F01D 11/005 277/644 |
| 9,341,072 | B2 * | 5/2016 | Hanumanthan | F01D 11/005 |
| 9,988,923 | B2 * | 6/2018 | Snyder | F01D 11/003 |
| 2006/0055118 | A1 * | 3/2006 | Beichl | F01D 11/005 277/346 |
| 2007/0297900 | A1 * | 12/2007 | Abgrall | F01D 5/225 415/209.3 |
| 2013/0084166 | A1 | 4/2013 | Klingels | |

FOREIGN PATENT DOCUMENTS

| | | | |
|---|---|---|---|
| JP | 2015-021387 | A | 2/2015 |
| WO | 2014/158276 | A2 | 10/2014 |
| WO | 2015/074787 | A1 | 5/2015 |

OTHER PUBLICATIONS

Jan. 10, 2017 Search Report issued in Great Britain Application No. 1613023.9.

* cited by examiner

SEALING ATTACHMENT FOR A GAS TURBINE ENGINE

TECHNICAL FIELD OF INVENTION

This invention relates to a sealing attachment for a gas turbine engine. In particular, the invention relates to a sealing attachment for radially attachment of a gas turbine wall to an engine casing. The preferable application of the invention is in a turbine stage of a gas turbine engine, however other areas of application are feasible and envisaged.

BACKGROUND OF INVENTION

FIG. 1 shows a ducted fan gas turbine engine 10 comprising in axial flow series: an air intake 12, a propulsive fan 14 having a plurality of fan blades 16, an intermediate pressure compressor 18, a high-pressure compressor 20, a combustor 22, a high-pressure turbine 24, an intermediate pressure turbine 26, a low-pressure turbine 28 and a core exhaust nozzle 30. A nacelle 32 generally surrounds the engine 10 and defines the intake 12, a bypass duct 34 and a bypass exhaust nozzle 36. The engine has a principal axis of rotation 31.

Air entering the intake 12 is accelerated by the fan 14 to produce a bypass flow and a core flow. The bypass flow travels down the bypass duct 34 and exits the bypass exhaust nozzle 36 to provide the majority of the propulsive thrust produced by the engine 10. The core flow enters in axial flow series the intermediate pressure compressor 18, high pressure compressor 20 and the combustor 22, where fuel is added to the compressed air and the mixture burnt. The hot combustion products expand through and drive the high, intermediate and low-pressure turbines 24, 26, 28 before being exhausted through the nozzle 30 to provide additional propulsive thrust. The high, intermediate and low-pressure turbines 24, 26, 28 respectively drive the high and intermediate pressure compressors 20, 18 and the fan 14 by concentric interconnecting shafts 38, 40, 42.

The turbines and compressors are constructed from axial arranged pairs of nozzle guide vanes and blades which are relatively rotatable. The vanes and blades each comprise aerofoil portions and platforms located at opposing ends of the aerofoils which define the main gas path. Thus, a nozzle guide vane may have radially inner and outer platforms with the aerofoil extending therebetween, and the blades may have inner platforms which are rotatably separated from the nozzle guide vane platforms. The tips of the blades may be so-called shrouded blades having integral shrouds which circumferentially combine to provide an annular wall which rotates with the blades. Such are arrangements and others are well known in the art.

A result of having relative rotation between the blades and vanes means that the main gas path wall is necessarily axially segmented. Axial segmentation of the gas path wall also aids construction and assembly of the engines amongst other advantages.

FIG. 2 shows a partial streamwise section of an intermediate pressure turbine 210 as highlighted in FIG. 1. The turbine includes a blade 212 and downstream vane 214 which forms part of the following vane-blade stage. The turbine blade 212 and vane 214 have aerofoil portions located within the main gas path 216. The blade 212 is a shrouded blade meaning that the tip of the blade terminates with a shroud platform 218 which circumferentially engages with adjacent shroud platforms to provide a full annulus. A seal segment 220 is positioned radially outboard of the shroud platform 218.

The downstream vane 214 includes an outer platform 222 which is integrally formed with the aerofoil portion. Both the seal segment 220 and outer vane platform 222 are held in a substantially stationary relation to the engine casing 224. The seal segment 220 and outer platform 222 are separate components which are axially separate but attached to one another to provide a substantially continuous gas path wall.

The seal segment 220 and outer platform 222 are attached to one another and to the engine casing 224. The attachments used can be any suitable type but are typically male and female connectors in the form of hook and grooves or so-called birdsmouth couplings 226. The birdsmouth couplings 226 include corresponding hook and groove formations on each of the components which engage axially with each other to provide an attachment therebetween. The birdsmouth couplings 226 principally provide radial restraint to the components with axial restraint provided by other means. It will be appreciated that hooks and grooves extend circumferentially around the seal shroud platform to the extent required to provide the radial restraint.

A problem with providing birdsmouth coupling 226 is that they have a tendency to leak during the inevitable relative movement between the axially adjacent parts. To combat this, the birdsmouth attachments 226 are often accompanied by one or more seals. Such a seal is shown in FIG. 2 and is in the form of a baffle seal 228.

The present invention seeks to provide an improved seal arrangement.

STATEMENTS OF INVENTION

The present invention provides male and female sealing attachments according to the appended claims.

Described below is a wall component for a gas turbine engine, the wall component comprising: a gas facing surface which bounds the main gas path; a male part of a male-female sealing attachment which radially locates a component within the gas turbine engine, the male part comprising: a main body having first and second arms extending therefrom in a common direction and either side of a mid-line plane, wherein either or both of the first and second arms are convexly curved in relation to the mid-line plane so as to provide a contact portion along the length of the arm, the contact portion being furthest from the mid-line plane.

The male-female sealing attachment may be a hook and groove attachment in which the hook and groove extend longitudinally in a circumferential direction. The male part may be an integral part of the wall component.

A male part of a male-female sealing attachment which radially locates a component within a gas turbine engine may comprise: a main body having first and second arms extending therefrom in a common direction and either side of a mid-line plane, wherein either or both of the first and second arms are convexly curved in relation to the mid-line plane so as to provide a contact portion along the length of the arm, the contact portion being furthest from the mid-line plane.

The first and second arms may be symmetrically arranged about the mid-line plane. The first and second arms may be coterminous at the distal ends thereof. The distal ends of the first and second arms may be connected via an end cap. The end cap may be convexly curved in relation to the main body.

The lateral thickness of the arms may be in the range of between 0.3 mm to 1.5 mm. The exterior span of the unengaged arms may be in the range of between 2.5 mm and 8 mm.

A female part of a male-female mechanical engagement for radially locating a component within a gas turbine engine may comprise: a main body having first and second arms extending therefrom in a common direction and either side of a mid-line plane, wherein either or both of the first and second arms are concavely curved in relation to the mid-line plane so as to provide a contact portion along the length of the arm, the contact portion being closest to the mid-line plane.

The first and second arms may be symmetrically arranged about the mid-line plane. The first and second arms may be cantilevered from the main body.

The thickness of the arms may be in the range: 0.3 mm to 1.5 mm.

A gas turbine may comprise: a wall component having a gas facing surface which bounds the main gas path; a male-female sealing attachment having either or both of a male part or female part in which: the male part includes a component having a main body, the main body having first and second arms extending therefrom in a common direction and either side of a mid-line plane, wherein either or both of the first and second arms are convexly curved in relation to the mid-line plane so as to provide a contact portion along the length of the arm, the contact portion being furthest from the mid-line plane; and, the female part includes a component having a main body, the main body having first and second arms extending therefrom in a common direction and either side of a mid-line plane, wherein either or both of the first and second arms are concavely curved in relation to the mid-line plane so as to provide a contact portion along the length of the arm, the contact portion being closest to the mid-line plane.

The male and female parts may be sealably engaged.

The wall component may be located in a turbine section of the gas turbine engine.

A male-female sealing attachment for radially locating a component within a gas turbine engine may comprise: a male part and a female part, either or both of the male and female parts having first and second arms extending from a main body on either side of an imaginary mid-line plane, wherein either or both of the first and second arms are resiliently deformable and curved to provide a contact portion which compressibly engages with an opposing corresponding surface of the other of the male or female part.

Within the scope of this application it is expressly envisaged that the various aspects, embodiments, examples and alternatives, and in particular the individual features thereof, set out in the preceding paragraphs, in the claims and/or in the following description and drawings, may be taken independently or in any combination. For example features described in connection with one embodiment are applicable to all embodiments, unless such features are incompatible.

DESCRIPTION OF DRAWINGS

Embodiments of the invention will now be described with the aid of the following drawings of which.

DETAILED DESCRIPTION OF INVENTION

Figure 3:
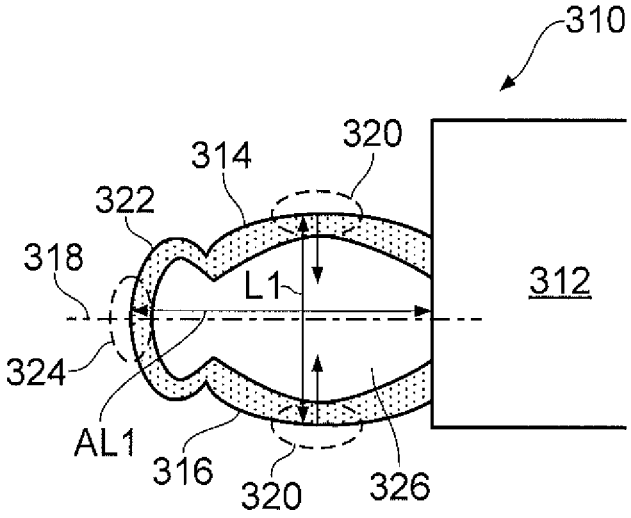
FIG. 3 shows a male part of a sealing attachment for radially locating a component.

FIG. 3 shows a male part 310 of a male-female seal which radially locates a component within a gas turbine engine. The male part 310 includes a portion of a component having a body 312 which is either directly or indirectly attached to a wall which bounds the main gas path of the gas turbine engine. The component can be part of a turbine stage and include any one or more of: a nozzle guide vane, blade platform, seal segment, carrier or an engine casing.

The main body 312 has first 314 and second 316 arms extending therefrom in a common direction. The arms 314, 316 are elongate having a longitudinal axis and proximal and distal ends relative to the main body 312. The arms 314, 316 are arranged either side of a mid-line plane 318 which sits between the arms 314, 316 and extends away from the main body 312. In the example shown in FIG. 3, the arms 314, 316 are symmetrically arranged in relation to the mid-line plane 318, however, although preferable, this may not be the case and the arms 314, 316 may have different forms depending on the sealing requirements.

The arms 314, 316 are curved so as to be convex such that a contact portion 320 is provided along the length of the arm 320, the contact portion 320 being furthest from the mid-line plane 318. The contact portion 320 is arranged to sealably contact against a corresponding portion of a female part of the male-female seal. The contact portion 320 shown is provided at an approximate mid-point along the length of the arms 314, 316, but this need not be so and a contact portion may be provided more distally or proximally as required.

The arms 314, 316 extend a similar distance from the main body 312 and as such are coterminous. The distal ends of the arms 314, 316 are connected by a lateral (with respect to the longitudinal axis of the arms) plate or end cap 322. The end cap 322 includes an optional convex curvature which is similar to that of the arms 314, 316. The convex curvature provides an end contact portion 324 on the end face of the male part which sealably abuts a corresponding surface of the female part.

The contacting portions 320 of the first 314 and second 316 arms provide the widest lateral span of the male part and are separated by a first lateral distance L1. The end cap is separated from the main body surface by a first axial distance AL1.

The combination of the arms 314, 316, end cap 322 and main body 312 surface define an enclosed compressible cavity 326. The arms 314, 316 have a lateral thickness which provides them with a flexural rigidity so as to be resiliently deformable. Thus, when received within a female part of the seal, the arms 314, 316, and end cap 322 when present, can deflect so as to flatten and provide a larger contacting surface. The resulting sealing surfaces provided by the resilient deformation of the arms and contacting portions also allow for some relative radial and axial movement between the female and male parts whilst maintaining the sealing contact therebetween.

Figure 4:
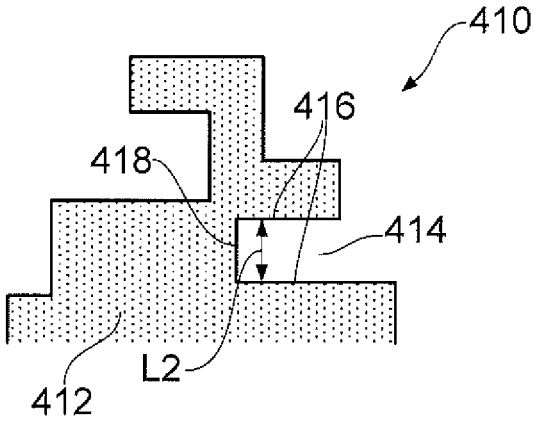
FIG. 4 shows a female part of a sealing attachment for engaging with a male part to provide a radially locating attachment.
Figure 5:
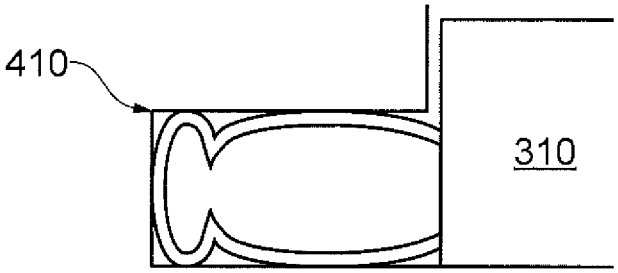
FIG. 5 shows mated male and female parts.

As shown in FIG. 5, the male part 310 of the seal is slidingly received within the corresponding female part 410. In the example shown in FIG. 4, the female part 410 is shown as part of a generic structure. Thus, there is female part main body 412 having an elongate groove 414 in a surface thereof. The groove 414 includes side walls 416 and a base 418. The side walls 416 are straight and separated by a uniform distance along the length thereof. The separation of the side walls 416 is a second distance L2 which is less than the first distance L1 provided by the separation between the contacting portions of the male component. Thus, when the male part 310 is received within the female part 410, the male contacting portions engage with the entrance to the female part and laterally compress the male part 310. Sliding the male part 310 home creates a sealing abutment between the corresponding male and female surfaces.

The male part 310 is inserted until the end cap 322 contacts the end face of the female part to create a sealing contact therebetween. In other examples, the end face may not contact on assembly but only in service under expected axial movements. Alternatively, the clearance between the end surface 322 and wall 418 may be such that there is no contact under normal operating conditions.

Figure 6:
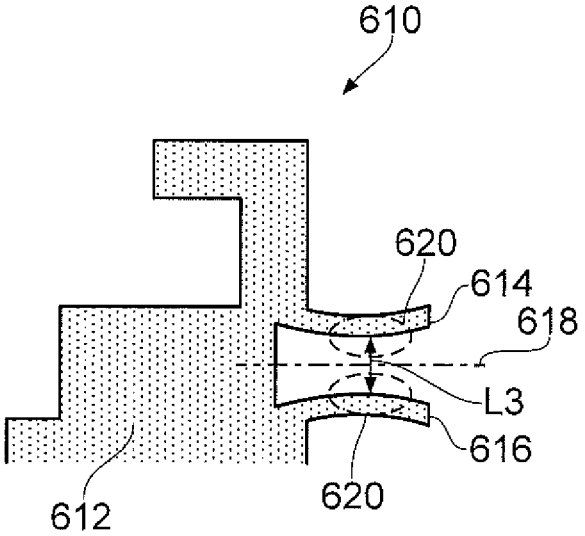
FIG. 6 shows an alternative female part of a sealing attachment for engaging with a male part to provide a radially locating attachment.

An alternative female part 610 is shown in FIG. 6. Here there is shown a female part 610 of a male-female sealing attachment which radially locates a component within a gas turbine engine. The female part 610 includes a portion of a component having a main body 612 which is either directly or indirectly attached to a wall which bounds the main gas path of the gas turbine engine. The main body 612 has first 614 and second 616 arms extending therefrom in a common direction. The arms 614, 616 are elongate having a longitudinal axis and proximal and distal ends relative to the main body 612. The arms 614, 616 are arranged either side of a mid-line plane 618 which sits between the arms 614, 616 and extends away from the main body 612. In the example shown in FIG. 6, the arms 614, 616 are symmetrically arranged in relation to the mid-line plane 618, however, although preferable, this may not be the case and the arms may have different forms depending on the sealing requirements.

The arms 614, 616 provide side walls for receiving and sealably engaging with a male part which is appropriately sized. A base is provided by the main body 612. The arms 614, 616 are curved so as to be concave such that a contact portion 620 is provided along the length of the each respective arm, the contact portion 620 being closest to the mid-line plane 618 and defining a minimum separation between the arms 614, 616. The contact portion 620 is arranged to sealably contact a corresponding portion of a male counterpart. The contact portion 620 shown is provided at an approximate mid-point along the length of the arms, but this need not be so and the contact portion 620 may be provided more distally or proximally as required.

The corresponding male part may be that shown in FIG. 3, or can be any suitable male component. For example, the male part may have an elongate construction with uniformly separated straight walls.

Figure 1:
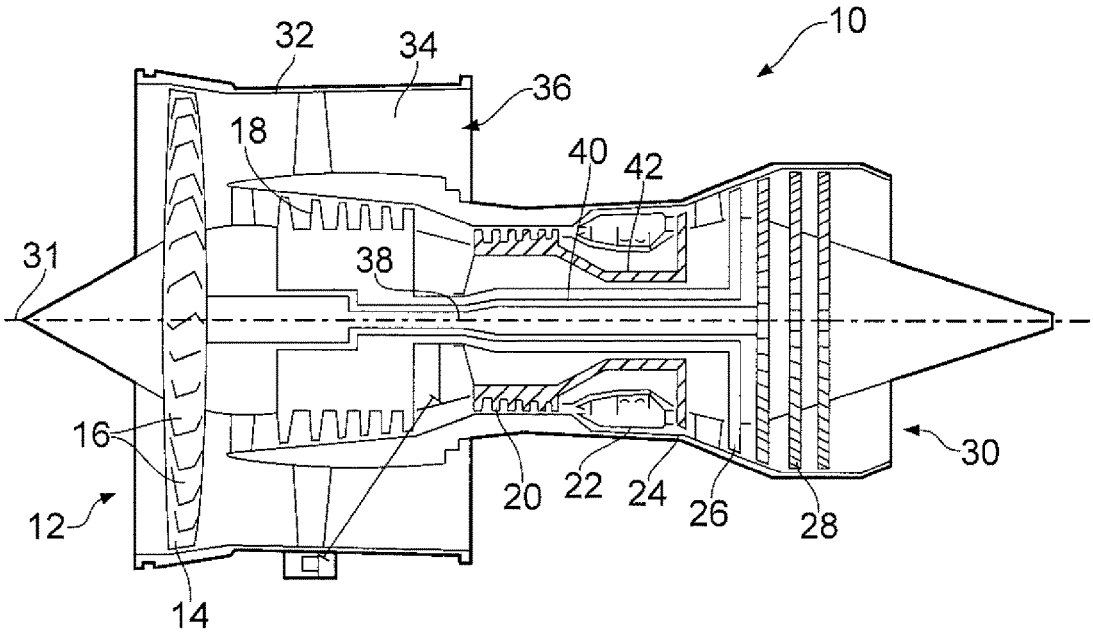
FIG. 1 shows a streamwise section of a conventional gas turbine engine.
Figure 2:
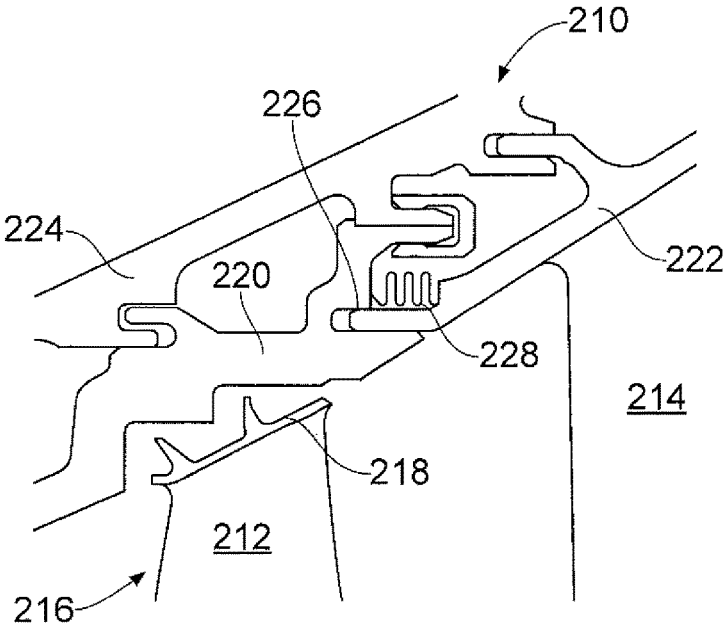
FIG. 2 shows a partial streamwise section of a turbine stage of a gas turbine engine.
Figure 7:
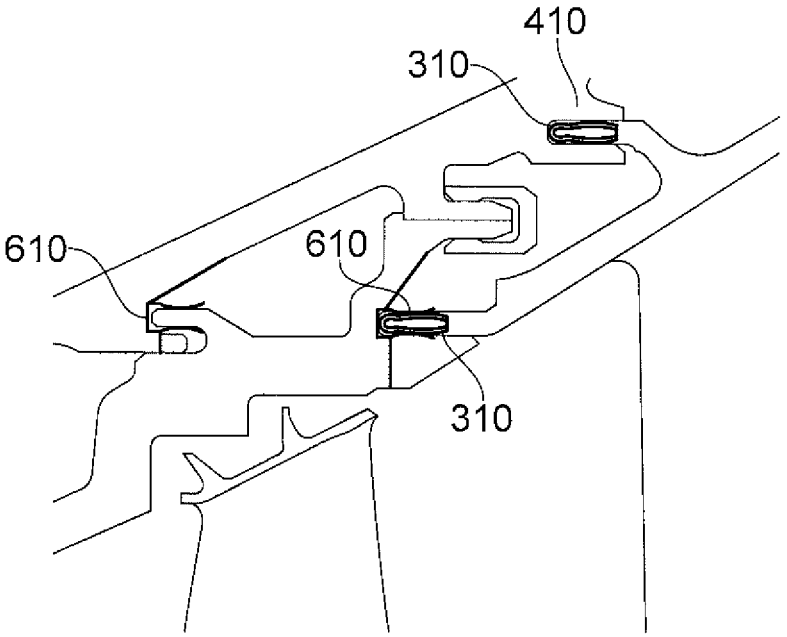
FIG. 7 shows a partial streamwise section of a turbine stage of a gas turbine engine incorporating mutually exclusive sealable attachments which radially locate gas wall components.

FIG. 7 shows a streamwise partial section of a gas turbine engine similar to the one shown in FIG. 2. However, in the representation of FIG. 7, the conventional birdsmouth attachments have been replaced with sealing attachments described above. Thus, there is a nozzle guide vane platform and seal segment being radially supported and located by combinations of the male and female parts of FIGS. 3, 4 and 6 and conventional counterparts. It will be appreciated that the combination of the male and female parts will be selected by according to the sealing and supporting requirements. Thus, the sealing element may include curved arms on either or both of the male or female parts. Further, the curved arms may have different geometries to each other and different from the ones described above. For example, the curvature of the female or male arms may be exclusively or a combination of concave or convex curvatures. The curvature may be defined by a single or multiple radii. One or more the arms in a male-female sealing attachment may be straight.

The components which are held in place with the hook and groove formations may provide a full annulus around the engine and main gas path. Such components may individually provide circumferential segments of the annulus. The circumferential segments may have circumferential end edges. The male and female connections of the examples described above may extend fully between the circumferential end edges.

The lateral thickness of the arms in the male and female parts may be in the range of between 0.3 mm to 1.5 mm. The maximum exterior span L1 of the unengaged arms may be in the range of between 2.5 mm and 8 mm. The maximum interior span L2 of the female part side walls 416 may be in the range of between 2 mm and 8 mm. The maximum interior span L3 of the resiliently deformable arms may be in the range of between 1.5 mm to 8 mm.

The male and female parts can be made using any suitable manufacturing method as known in the art. Additive layer manufacturing techniques such as direct laser deposition are particularly suited to creating the required convex and concave features in a cost effective manner.

It will be understood that the invention is not limited to the described examples and embodiments and various modifications and improvements can be made without departing from the concepts described herein and the scope of the claims. Except where mutually exclusive, any of the features may be employed separately or in combination with any other features and the disclosure extends to and includes all combinations and sub-combinations of one or more described features.

The invention claimed is:

1. A wall component for a gas turbine engine, the wall component comprising:

a gas facing surface forming a boundary for a main gas path; and a male part of a male-female sealing attachment, the male part including:

a main body having a first arm and a second arm, the first arm and the second arm extending from the main body in a common direction, the first arm being disposed on an opposite side of the second arm with respect to a mid-line plane, the first arm and the second arm each having a convex curve with respect to the mid-line plane, the first arm having a first contact portion and the second arm having a second contact portion each formed at a location of the respective first arm and the second arm that is a maximum distance from the mid-line plane, and an end cap formed on a distal end of the first arm and on a distal end of the second arm with respect to the main body, the end cap having an end convex curve that is distinct from the convex curves of the first arm and the second arm.

2. The wall component as claimed in claim 1, wherein the male-female sealing attachment is a hook and groove attachment, the hook and groove attachment extending longitudinally in a circumferential direction of the gas turbine engine.

3. The wall component as claimed in claim 2, wherein the male part is an integral part of the wall component.

4. The wall component as claimed in claim 1, wherein the first arm and the second arm are symmetrically arranged about the mid-line plane.

5. The wall component as claimed in claim 1, wherein the first arm and the second arm are coterminous at the distal ends of the respective first arm and the second arm.

6. The wall component as claimed in claim 1, wherein a lateral thickness of the first arm and the second arm is each in a range between 0.3 mm to 1.5 mm.

7. The wall component as claimed in claim 1, wherein an exterior span of the first arm and the second arm is in a range between 2.5 mm and 8 mm.

8. The wall component as claimed in claim 1, wherein the wall component is a seal segment of a turbine section of the gas turbine engine.

9. The wall component as claimed in claim 1, wherein at least one of the first and second arms is deformable so that at least one the first contact portion and the second contact portion is configured to compressibly engage with an opposing corresponding surface of a female part.

10. A gas turbine comprising:

a wall component having a gas facing surface forming a boundary for a main gas path; and a male-female mechanical attachment including:

a male part includes a component having including:

a male main body, the male main body having a first arm and a second arm extending from the male main body in a first common direction, the first arm being disposed on an opposite side of the second arm with respect to a mid-line plane, the first arm and the second arm each having a convex curve with respect to the mid-line plane, the first arm having a first contact portion and the second arm having a second contact portion each formed at a location of the respective first arm and the second arm that is a maximum distance from the mid-line plane, and an end cap formed on a distal end of the first arm and on a distal end of the second arm with respect to the male main body, the end cap having an end convex curve that is distinct from the convex curves of the first arm and the second arm; and a female part having a female main body, the female main body having a third arm and a fourth arm extending from the female main body in a second common direction, the third arm being disposed on an opposite side of the fourth arm with respect to the mid-line plane, the third arm and the fourth arm each having a concave curve with respect to the mid-line plane, the third arm having a third contact portion and the fourth arm having a fourth contact portion each formed at a location of the respective third arm and the fourth arm that is a minimum distance from the mid-line plane.

11. The gas turbine as claimed in claim 10, wherein the male and female parts are sealably engaged.

12. The gas turbine engine as claimed in claim 11, wherein the wall component is located in a turbine section of the gas turbine engine.

13. The gas turbine engine as claimed in claim 12, wherein the third arm and the fourth arm are symmetrically arranged about the mid-line plane.

14. The gas turbine engine as claimed in claim 12, wherein the third arm and the fourth arm are cantilevered from the female main body.

15. The gas turbine engine as claimed in claim 12, wherein a thickness of each of the third arm and the fourth arm is in a range of 0.3 mm to 1.5 mm.

* * * * *